US012385651B2

(12) United States Patent
Fieger et al.

(10) Patent No.: US 12,385,651 B2
(45) Date of Patent: Aug. 12, 2025

(54) STEAM EXTRACTOR DEVICE, KITCHEN APPLIANCE HAVING A HOB SECTION AND A STEAM EXTRACTOR DEVICE, AND METHOD FOR OPERATING A STEAM EXTRACTOR DEVICE

(71) Applicant: BSH Hausgeräte GmbH, Munich (DE)

(72) Inventors: Daniel Fieger, Kronau (DE); Eugen Maurer, Eisingen (DE); Ulmar Neumann, Forst (DE); Stefan Schabinger, Bretten (DE); Carsten Schweinebart, Karlsruhe (DE); Michael Wolters, Bretten (DE)

(73) Assignee: BSH Hausgeräte GmbH, Munich (DE)

( * ) Notice: Subject to any disclaimer, the term of this patent is extended or adjusted under 35 U.S.C. 154(b) by 885 days.

(21) Appl. No.: 17/439,427

(22) PCT Filed: Feb. 28, 2020

(86) PCT No.: PCT/EP2020/055315
§ 371 (c)(1),
(2) Date: Sep. 15, 2021

(87) PCT Pub. No.: WO2020/221492
PCT Pub. Date: Nov. 5, 2020

(65) Prior Publication Data

US 2022/0154946 A1 May 19, 2022

(30) Foreign Application Priority Data

Apr. 30, 2019 (DE) ..... 10 2019 206 240.7

(51) Int. Cl.
*F24C 15/20* (2006.01)

(52) U.S. Cl.
CPC ..... *F24C 15/2042* (2013.01)

(58) Field of Classification Search
CPC ..... F24C 15/2042
See application file for complete search history.

(56) References Cited

U.S. PATENT DOCUMENTS 1,596,096 A * 8/1926 Greenlaw ..... F24C 15/2042 126/300
4,043,257 A * 8/1977 Aaberg ..... F24F 9/00 454/49

(Continued)

FOREIGN PATENT DOCUMENTS

CN 108224517 A 6/2018
DE 102010042436 A1 4/2012

(Continued)

OTHER PUBLICATIONS

International Search Report PCT/EP2020/055315 dated May 26, 2020.

(Continued)

*Primary Examiner* — Michael G Hoang
*Assistant Examiner* — Logan P Jones
(74) *Attorney, Agent, or Firm* — Michael E. Tschupp; Andre Pallapies; Brandon G. Braun

(57) ABSTRACT

An extractor apparatus includes a suction opening, a fan arranged under the suction opening for sucking away primary air downward via the suction opening, and an expulsion opening which is adjacent to the suction opening and via which an oriented secondary air stream is expelled.

22 Claims, 14 Drawing Sheets

(56) References Cited

U.S. PATENT DOCUMENTS 4,551,600 A * 11/1985 Miyagawa ..... H05B 6/1263 126/299 D
4,665,893 A * 5/1987 Miyagawa ..... H05B 6/1263 126/39 BA
4,899,028 A 2/1990 Arai
6,347,626 B1 2/2002 Yi
6,632,132 B1 * 10/2003 Kikuchi ..... F24C 15/2028 454/189
7,836,877 B2 11/2010 Gagas
8,003,925 B2 * 8/2011 Okada ..... H05B 6/1263 219/677
9,468,958 B2 * 10/2016 Hammers ..... B08B 15/002
2006/0154590 A1 * 7/2006 Kanaya ..... F24C 15/2028 454/56
2010/0126123 A1 * 5/2010 Martic ..... F24C 15/2028 55/438
2013/0042853 A1 * 2/2013 Chiang ..... F24C 15/2042 126/299 D
2013/0125764 A1 * 5/2013 Jeong ..... F24C 15/2078 55/385.2
2015/0316273 A1 11/2015 So
2018/0195738 A1 * 7/2018 Park ..... F04D 29/701

FOREIGN PATENT DOCUMENTS

DE 102015111337 A1 * 1/2017
DE 102017216456 A1 3/2019
JP 2001340227 A * 12/2001
JP 2010207658 A * 9/2010
KR 20050100335 A * 10/2005
WO WO-2006092303 A1 * 9/2006 ..... F24C 15/2042
WO WO-2008058761 A2 * 5/2008 ..... F24C 15/20

OTHER PUBLICATIONS

Neport of Examination AU 2020266966 dated Dec. 20, 2022.
National Search Report EP 22153673.3 dated Jun. 10, 2022.

* cited by examiner

STEAM EXTRACTOR DEVICE, KITCHEN APPLIANCE HAVING A HOB SECTION AND A STEAM EXTRACTOR DEVICE, AND METHOD FOR OPERATING A STEAM EXTRACTOR DEVICE

CROSS-REFERENCES TO RELATED APPLICATIONS

This application is the U.S. National Stage of International Application No. PCT/EP2020/055315, filed Feb. 28, 2020, which designated the United States and has been published as International Publication No. WO 2020/221492 A1 and which claims the priority of German Patent Application, Serial No. 10 2019 206 240.7, filed Apr. 30, 2019, pursuant to 35 U.S.C. 119(a)-(d).

BACKGROUND OF THE INVENTION

The present invention relates to an extractor apparatus, a kitchen appliance with a cooktop and an extractor apparatus, and also a method for operating an extractor apparatus.

To clean the fumes and vapors created during cooking on a cooktop, a known solution is to use extractor hoods that are fixed above the cooktop, for example on a wall of the room. These extractor hoods suck away the fumes and vapors in an upward direction. Additionally, so-called downdraft ventilation systems or countertop ventilation systems, which can also be referred to as cooktop ventilation systems, are also known, in which fumes and vapors are sucked away downward. An embodiment of a downdraft ventilation system is described in DE 10 2010 042 436 A1 for example. This downdraft ventilation system utilizes a suction unit capable of traversing vertically out of a cooktop, with a vertical suction opening.

In the case of cooktop ventilation systems the rising vapor is sucked in downward or to the side, against the physical uplift. High air speeds or suction powers are required for this, which are accompanied by a high noise level. In the event of large distances between the cooking vessel and the suction opening, vapor capture is not achieved, or the rate of vapor capture is low. Moreover most cooktop ventilation systems struggle to capture the rising vapor from taller cooking vessels such as pots. If cross-currents develop in the room, then additionally a markedly reduced vapor capture is observed.

BRIEF SUMMARY OF THE INVENTION

The object underlying the invention is therefore to create a solution with which the vapor suction behavior of a cooktop ventilation system can be improved with a lower delivery volume requirement.

The invention is based on the finding that this can be achieved by means of targeted air routing of a secondary air stream, which influences, at least in the vicinity of the suction opening, the vapor being sucked in.

According to a first aspect, the object is consequently achieved by an extractor apparatus having a suction opening and, arranged under the suction opening, a fan by means of which the primary air is sucked away downward via the suction opening. The extractor apparatus is characterized in that the extractor apparatus has at least one expulsion opening which is adjacent to the suction opening and via which an oriented secondary air stream is expelled.

Extractor apparatus is the designation for an apparatus by means of which air, in particular contaminated air in the form of fumes and vapors, can be sucked away from a cooktop and/or a countertop. Preferably the extractor apparatus has at least one filter element for cleaning the air. In particular at least one grease filter and where relevant an odor filter can be provided in the extractor apparatus. The extractor apparatus has a suction opening. According to the invention multiple suction openings can also be provided on the extractor apparatus. However the invention is essentially described below with reference to an extractor apparatus with only one suction opening. A fan is arranged below the suction opening. Multiple fans can also be provided in the extractor apparatus. However the invention is essentially described below with reference to an extractor apparatus with one fan. The fan can also be referred to as a blower or exhauster. By means of the fan air is sucked away downward via the suction opening. The air that is sucked away is referred to as primary air and represents in particular contaminated air in the form of fumes and vapors. The extractor apparatus therefore represents a cooktop ventilation system, which can also be referred to as a downdraft ventilation system or countertop ventilation system.

The extractor apparatus is characterized in that it has at least one expulsion opening that is adjacent to the suction opening and via which an oriented secondary air stream is expelled. The at least one expulsion opening can be implemented in the form of a hole or a slit. The scope of the invention also includes however the at least one expulsion opening being formed by a pipe end or an opening in the outer wall of a pipe in each case. In this case the expulsion opening can also be referred to as a nozzle. The air routing from the fan to the at least one expulsion opening can be effected by using a duct, which can have a round or rectangular cross-section (flat duct). The expulsion opening is arranged adjacent to the suction opening. Adjacent to the suction opening refers to an expulsion opening that lies at a small distance in the horizontal direction with regard to the suction opening and preferably borders on the suction opening, and is only separated from the suction opening by a separating element where appropriate. In the vertical direction the at least one expulsion opening can lie in the plane of the suction opening or in particular in the case of a so-called downdraft extractor apparatus with a suction unit with suction opening in the vertical, offset downward with regard to the suction opening. Preferably the suction opening lies in the horizontal direction between the space from which air is to be sucked away, in particular the space above a cooktop, and the at least one expulsion opening.

An oriented secondary air stream is expelled via at least one expulsion opening. The secondary air stream is also referred to below as incoming air stream, subsidiary air stream, or secondary fluid stream or secondary fluid. The secondary air can be fresh air from the room in which the extractor apparatus is being operated, fresh air from outside the room, or fumes and vapors sucked out of the room and preferably cleaned. Oriented air stream refers to an air stream which due to the geometry of the expulsion opening and/or the speed with which the air stream is expelled, flows in a predetermined direction at least over a certain distance.

Given that according to the invention at least one expulsion opening is provided adjacent to the suction opening and an oriented secondary air stream can be expelled via said expulsion opening, the direction and speed of the primary air stream, which are determined by the fan and the thermal conditions on a cooktop, can be changed or supported in a targeted manner in at least some areas. In particular the primary air stream can be steered to the suction opening. As a result of this the volumetric flow sucked in via the suction opening can be increased and/or the requirement placed on the fan to suck away the primary air reduced. With the present invention therefore the vapor capture rate and therefore the efficiency of the extractor apparatus can be increased. Additionally the fan can be operated at lower power or a smaller fan, that is to say a fan with a lower nominal power, can be used. This results in the noise generated during suction of the primary air being reduced and the energy requirement being lowered.

If multiple expulsion openings are provided on the extractor apparatus, then the same can be arranged in a common alignment. The scope of the invention also includes however a first group of expulsion openings being aligned in a first direction and a second group in a second direction. Additionally it is also possible for every expulsion opening to be aligned in a different direction.

According to an embodiment, at least one expulsion opening lies in the horizontal. In the case of this arrangement of the at least one expulsion opening the secondary air can be output upward in the vertical direction.

Unless stated otherwise indications of direction, such as up, down, front, and back refer to an extractor apparatus in the installed state behind a cooktop. The direction indication front with regard to the extractor apparatus refers to the side of the extractor apparatus facing the cooktop. For easier reference a system of coordinates is indicated in FIG. 3, which is referred to below. In this regard the x axis lies in the horizontal and extends in the depth direction of the extractor apparatus and of a cooktop arranged in front of the extractor apparatus. The y axis likewise lies in the horizontal, extends perpendicular to the x axis and runs in the width direction of the extractor apparatus and the cooktop. The z axis lies in the vertical and therefore runs in the height direction of the extractor apparatus and lies perpendicular to the x and y axes.

Given that at least one expulsion opening lies in the horizontal, the secondary air can be output via the expulsion opening in a direction that has at least one vertical direction component and for example is oriented vertically upward. Additionally the construction of the extractor apparatus can be simplified as a result of the horizontal position of the at least one expulsion opening. In particular the expulsion opening or openings can lie at the height that corresponds to the height of the cooktop. As a result, the provision of a separate expulsion duct extending over the height of the upper side of the cooktop is not required.

According to a further embodiment at least one expulsion opening lies in the vertical. As a result of this alignment a secondary air stream can be output via the at least one expulsion opening, which secondary air stream has at least one horizontal direction component. By way of example the secondary air stream can be output in the horizontal. Via the expulsion opening lying in the vertical in particular a secondary air stream can be generated that is oriented to one of the sides of the extractor apparatus and therefore to one of the sides of the cooktop.

According to a further embodiment at least one expulsion opening is tilted with regard to the vertical and horizontal. In the case of this arrangement it is possible with a simple configuration of the expulsion opening for the same to be realized for example in the form of a hole or a slot via which secondary air is output in a direction transverse to the horizontal and vertical. In this embodiment the expulsion openings can be arranged for example on the upper side of a semicircular-shaped duct, and therefore a fanlike-shaped secondary air stream can be output upward via these expulsion openings. In place of a simple hole or slit a nozzle can also form the expulsion opening.

As already mentioned above, where multiple expulsion openings are provided, the alignments of the individual expulsion openings with regard to each other can be the same or different.

According to a further embodiment at least one expulsion opening is oriented upward. In this regard oriented upward refers to an expulsion opening via which secondary air can be output in a direction with a direction component oriented vertically upward. The direction of the expulsion opening can be determined by means of its arrangement on the extractor apparatus and where relevant additionally by means of its geometry. For example an expulsion opening lying in the horizontal can be formed by a bore or a hole that runs tilted to the vertical. Therefore a secondary air stream can be output via this horizontally lying expulsion opening that flows obliquely upward. Given that the expulsion direction is oriented upward the secondary air can form an air curtain that splits off the area above the cooktop. Additionally the primary air can be influenced in a targeted manner above the plane of the cooktop. In particular at least part of the primary air can be carried along counter to the main suction direction of the suction opening. The resulting effect is described in detail below.

According to a further embodiment the expulsion opening lies above the plane of the suction opening and is tilted downward. In an embodiment in which the extractor apparatus comprises a downdraft extractor apparatus with vertical suction opening the expulsion opening can lie above the plane in which the suction unit projects upward out of the casing of the extractor apparatus, in particular above the plane of the cooktop, and be tilted downward. Tilted downward refers to an expulsion opening via which secondary air can be output in a direction which has at least one direction component oriented downward. Preferably the expulsion opening is aligned in this regard such that the secondary air always has a horizontal direction component, that is to say is not output vertically downward. Via an expulsion opening tilted downward the secondary air can influence the primary air, at least partly, in the direction of the suction opening.

The at least one expulsion opening can be provided on an expulsion duct. The expulsion duct can be provided in the extractor apparatus such that its upper side lies in the plane of the suction opening. In particular the upper side of the expulsion duct can lie in the plane of the cooktop and a countertop in which the cooktop is installed. This plane preferably corresponds to the plane of the suction opening. However in an embodiment in which the extractor apparatus comprises a downdraft extractor apparatus the plane of the suction opening lies above the plane of the cooktop and a possibly provided countertop. In this embodiment the expulsion duct is arranged in an embodiment such that the upper side of the expulsion duct lies in the plane of the cooktop and, where relevant, of the countertop.

According to an embodiment the at least one expulsion opening is provided on an expulsion duct which extends upward from the plane in which the suction opening is located. The plane in which the suction opening lies is preferably the plane of the cooktop. However in an embodiment in which the extractor apparatus comprises a downdraft extractor apparatus the plane of the suction opening lies above the plane of the cooktop and a possibly provided countertop. In this embodiment the expulsion duct extends upward from the plane of the cooktop and where relevant of the countertop. Given that the expulsion duct extends upward over the plane of the cooktop and preferably the plane of the suction opening the targeted influencing of the primary air produced over the cooktop can be ensured in a simple manner since the expulsion openings can be arranged at a certain height over the cooktop.

The suction opening preferably has a width that corresponds to the width of the cooktop from which the primary air is to be sucked in. The width, that is to say the extension of the suction opening in the Y direction, is preferably greater than its depth, that is to say its extension in the X direction in the coordinate system defined in FIG. 3.

According to an embodiment the expulsion duct that extends upward from the plane of the cooktop is arranged in the center of the width of the suction opening. Alternatively two expulsion ducts are provided that are arranged at the lateral ends of the width of the suction opening. In both cases the expulsion duct is arranged adjacent and preferably offset to the rear with regard to the suction opening. In the arrangement of the expulsion duct in the center of the width of the suction opening expulsion openings are preferably provided at both sides of the expulsion duct that lie in the width direction, that is to say in the Y direction. In the embodiment in which two expulsion ducts are provided and arranged with one at each lateral end of the width of the suction opening expulsion openings are only installed in one side of the respective expulsion duct.

According to a preferred embodiment the extractor apparatus has a separating element, which is arranged between the suction opening and the at least one expulsion opening. The separating element is preferably a flat element that extends over the entire width of the suction opening. Given that a separating element is provided the direct suction of secondary air into the suction opening can be prevented, even in the case of a low speed of the secondary air, in particular where the at least one expulsion opening is arranged in the plane of the suction opening. However it is also possible, in the case of sufficient speed and where relevant suitable alignment of the secondary air stream, for no separating element to lie between the suction opening and the at least one expulsion opening. In this regard mixing of the secondary air and the primary air below the plane of the suction opening can be prevented by the rear wall of a suction duct, the upper side of which forms the suction opening, and/or the front wall of an expulsion duct.

The separating element preferably extends vertically upward from the plane of the suction opening. This results in the secondary air stream being output from an expulsion opening behind the separating element being routed in a targeted manner at least over the section over which the secondary air stream flows along the separating element. Additionally a separating element extending vertically upward reliably prevents the direct suction of secondary air into the suction opening.

According to an embodiment the separating element is a deflector plate. The deflector plate can be fixed to the extractor apparatus so as to be capable of moving, in particular the deflector plate can be moved into and out of the casing of the extractor apparatus. As a result different heights of cooking vessels can be allowed for, or the deflector plate moved in when the extractor apparatus is not in use. Alternatively the deflector plate can also be fixed to the extractor apparatus in a stationary manner. The deflector plate can comprise a disk, for example made of glass, plastic, or metal. Where a deflector plate is used as a separating element, the spacing between the flow existing in front of the deflector plate and the flow existing behind the deflector plate is small. This makes it possible for the two flows to exert an influence on each other at the edges of the deflector plate. In particular if a thin separating element is used, in particular a deflector plate, then no undesirable eddy formation is produced at the edges of the deflector plate.

Preferably the deflector plate has a thickness in the range 2 mm to 20 mm. Particularly preferably the thickness of the deflector plate lies in the range 5 mm to 10 mm, in particular at 6 mm. It has been found that with a deflector plate of this thickness a targeted realization of eddies can be achieved at the upper edge of the deflector plate, or at least the same is assisted. The eddies result in the primary air stream being additionally steered to the suction opening.

According to an alternative embodiment the separating element is a suction unit, which has at least one suction opening on the side facing away from the at least one expulsion opening. The suction unit can also be referred to as a suction duct. In the embodiment in which the separating element comprises a suction unit the extractor apparatus comprises a so-called downdraft extractor apparatus. The suction unit can be fixed to the casing of the extractor apparatus in a stationary or moveable manner. The suction unit preferably has a small depth.

The secondary air stream output via the at least one expulsion opening can be generated by the fan in the extractor apparatus. In particular part of the primary air sucked in via the suction opening and where relevant cleaned in the extractor apparatus can be branched off via a bypass and fed to the expulsion openings. This results in the formation of a variable secondary air stream, that is to say dependent on the primary air stream. In this embodiment the speed of the secondary air stream can be additionally determined by the geometry of the expulsion openings where relevant.

According to an embodiment part of the exhaust air stream can therefore be used to exert an advantageous influence on the vapor. In this regard part of the air, where relevant cleaned of grease and odors, can be removed from the exhaust air stream by way of a bypass. For the purpose of the present invention exhaust air stream refers to the air stream that has been sucked in and cleaned by the extractor apparatus. Alternatively this air can be fed back into the room in which the extractor apparatus is being operated, or released to the surroundings. Consequently the extractor apparatus can be implemented in the form of an exhaust air or circulating air extractor apparatus.

According to an embodiment the extractor apparatus has a supplementary fan, which is connected to the at least one expulsion opening. In this embodiment fresh air can be sucked in from the room in which the extractor apparatus is being operated or from the surroundings and expelled from the expulsion openings as a secondary air stream. In this embodiment therefore a constant secondary air stream can be generated. For example the supplementary fan can suck in a fresh air stream from the cabinet base unit in order to exert an advantageous influence on the vapor. In this regard clean air is sucked in from the kitchen base unit. Alternatively clean air can be sucked in from outside.

According to a further aspect the invention relates to a kitchen appliance with a cooktop and at least one extractor apparatus, which comprises an inventive extractor apparatus.

Advantages and features described with reference to the extractor apparatus also apply—where applicable—to the inventive kitchen appliance and vice versa, and are consequently only described once where relevant.

The kitchen appliance has a cooktop and at least one extractor apparatus. The cooktop and the extractor apparatus can be installed in a countertop. In this regard the cooktop and extractor apparatus(es) can be installed in a common cutout in the countertop. The scope of the invention also includes however that the at least extractor apparatus and the cooktop are installed in separate cutouts in the countertop. Preferably the at least one extractor apparatus is provided on a margin of the cooktop such that the suction opening of the extractor apparatus extends along the margin of the cooktop.

Additionally the suction opening is arranged in the horizontal direction between the at least one expulsion opening and the cooktop. This means that the suction opening lies closer to the cooktop than the at least one expulsion opening. Additionally the influencing of the primary air stream sucked in via the suction opening takes place in the vicinity of the suction opening. The invention therefore differs from extractor apparatuses in which an incoming air stream is generated at the side of the cooktop opposite the suction opening, and is oriented toward the suction opening.

According to a preferred embodiment the at least one extractor apparatus is arranged behind the cooktop. Arranged behind the cooktop refers to an extractor apparatus in which the suction opening and the at least one expulsion opening lie in the negative X direction in the coordinate system according to FIG. 3. In this position it is possible, for example in the case of a cooktop installed in an island unit, for an air curtain to be realized behind the cooktop, and therefore an influencing of the flow conditions over the cooktop from behind can be prevented.

According to an embodiment the extractor apparatus has a deflector plate, which is provided as a separating element between the suction opening and the at least one expulsion opening. The width of the deflector plate corresponds for example to the width of the cooktop. This enables targeted screening of the suction opening, which preferably likewise corresponds to the width of the cooktop.

According to a further aspect the invention relates to a method of operating an inventive extractor apparatus. The method is characterized in that at least one secondary air stream is output via the at least one expulsion opening such that the at least one secondary air stream is oriented via the sides of the suction opening to the outside.

The secondary air stream oriented via the sides to the outside can also be referred to as an air curtain or air film, and is preferably fed by more than one expulsion opening. The air curtain can comprise a continuous curtain or be formed of individual secondary air streams. In the latter case the speed of the air can vary slightly across the air curtain. The secondary air stream is at least oriented via the sides of the suction opening to the outside. The sides of the suction opening refer to the longitudinal ends of the preferably oblong suction opening. The secondary air stream is therefore oriented in the width direction of the suction opening and therefore also in the width direction of the extractor apparatus and of the cooktop. As a result of this alignment of the secondary air stream, the same lies transverse to the main direction of the primary air stream, which is sucked from the cooktop in the direction of the suction opening by the suction of the fan. As a result, firstly, the escape of vapor to the rear can be prevented since the secondary air stream can serve as an air curtain and screen the area over the cooktop to the rear. Secondly at least part of the primary air stream can be carried along by the secondary air stream as a result of the direction of the secondary air stream, the same lying transverse to the flow direction of the primary air stream in the negative x direction. As a result of that part of the primary air stream being carried away, then for continuity reasons further primary air follows in the direction of the suction opening, and can be sucked into the suction opening by the fan of the extractor apparatus. In addition to the alignment to the outside the secondary air stream can also be oriented upward or downward at least in some areas.

When a deflector plate is provided the air curtain preferably forms parallel to the deflector plate and forms virtually an extension of the deflector plate to both sides and obliquely upward. It distinguishes the lateral areas in front of and behind the deflector plate from each other. This also prevents a lot of primary air coming from the sides from being sucked in.

Advantages and features that are and have been described with reference to the inventive method also apply—where applicable—to the inventive extractor apparatus and the inventive kitchen appliance and vice versa in each case, and are consequently only described once where relevant.

According to an embodiment the secondary air stream is aligned such that the same lies in a plane that is parallel to a plane in which the longitudinal projection of the suction opening lies. According to the invention however it is also possible for the secondary air stream to be oriented in a direction that is tilted forward, in particular toward the cooktop. This tilting of the secondary air stream is preferably small however, and in particular less than 90, preferably less than 45. According to an embodiment the secondary air stream can be output such that the same is oriented, at least in some areas, from behind on to a separating element, flows along the separating element and flies off from the lateral edge of the separating element, and flows laterally to the outside.

According to a preferred embodiment the secondary air is output in a fanlike shape. In this regard a secondary air stream that is output from an expulsion opening can be fanned out. Alternatively secondary air streams from multiple expulsion openings can form a fanlike shape together.

According to an embodiment the secondary air flows upward at least in the perimeter area of the upper edge of the separating element and the secondary air stream forms, in the central area of the upper edge of the separating element, at least one eddy. The center of the at least one eddy lies in front of the separating element. Given that the center of the eddy lies in front of the separating element, the same can, firstly, reliably prevent the escape of primary air upward, and additionally steers rising primary air at an early point downward in the direction of the suction opening, therefore supporting the suction function. Preferably two symmetrical eddies are realized. In the case of an air stream divided into two fanlike shapes in particular one eddy preferably forms in each case at the sides of the respective fanlike part that are facing each other, that is to say between which no secondary air is flowing upward. The eddies therefore lie in the central area of the width of the upper edge of the deflector plate. In this regard the two eddies can be separate from each other or form one common eddy in the width direction of the deflector plate. The axis of the eddy or eddies lies parallel to the deflector plate.

The speed of the secondary air stream is preferably greater than the speed of the primary air flow at the suction opening. As a result direct suction of the secondary air into the suction opening can be prevented, even without a separating element.

According to an embodiment the average outgoing speed of the secondary air at the expulsion opening lies in the range 6 to 7 m/s at a volumetric flow of the secondary air of 120 to 150 $m^3/h$. For example an outgoing speed of the secondary air can be set in the range 6 to 7 m/s at a volumetric flow in the range 130 to 150 $m^3/h$. In this regard the outgoing speed refers to the vertical speed component.

The outgoing speed can be higher by altering the geometry of the outlet opening, in particular of nozzles with a smaller outlet opening, or lower in the case of nozzles with a larger outlet opening. The outgoing speed gives an average outgoing speed where the outgoing speed via the outlet opening or nozzles provided in the same can be distributed unevenly. If low outgoing speeds are used then it is preferable to set a high volumetric flow, to continue to obtain the advantages of the invention.

By means of the present invention targeted air routing and influencing of the primary air can be effected in simple fashion, for example by adjusting the parameters of the thickness of the deflector plate, the suction power of the fan, the size and position of the suction opening, the height of the deflector plate, and also the volumetric flow, the speed and the direction of the secondary air stream. In particular at least one eddy can be realized in the secondary air at the upper side of the deflector plate, as a result of which the primary air can firstly be impeded from escaping and sliding past over the upper edge of the deflector plate, and additionally the same supports the sucking in of the primary air.

BRIEF DESCRIPTION OF THE DRAWINGS

The present invention is described again below with reference to the enclosed figures. These show.

DETAILED DESCRIPTION OF EXEMPLARY EMBODIMENTS OF THE PRESENT INVENTION

Figure 1:
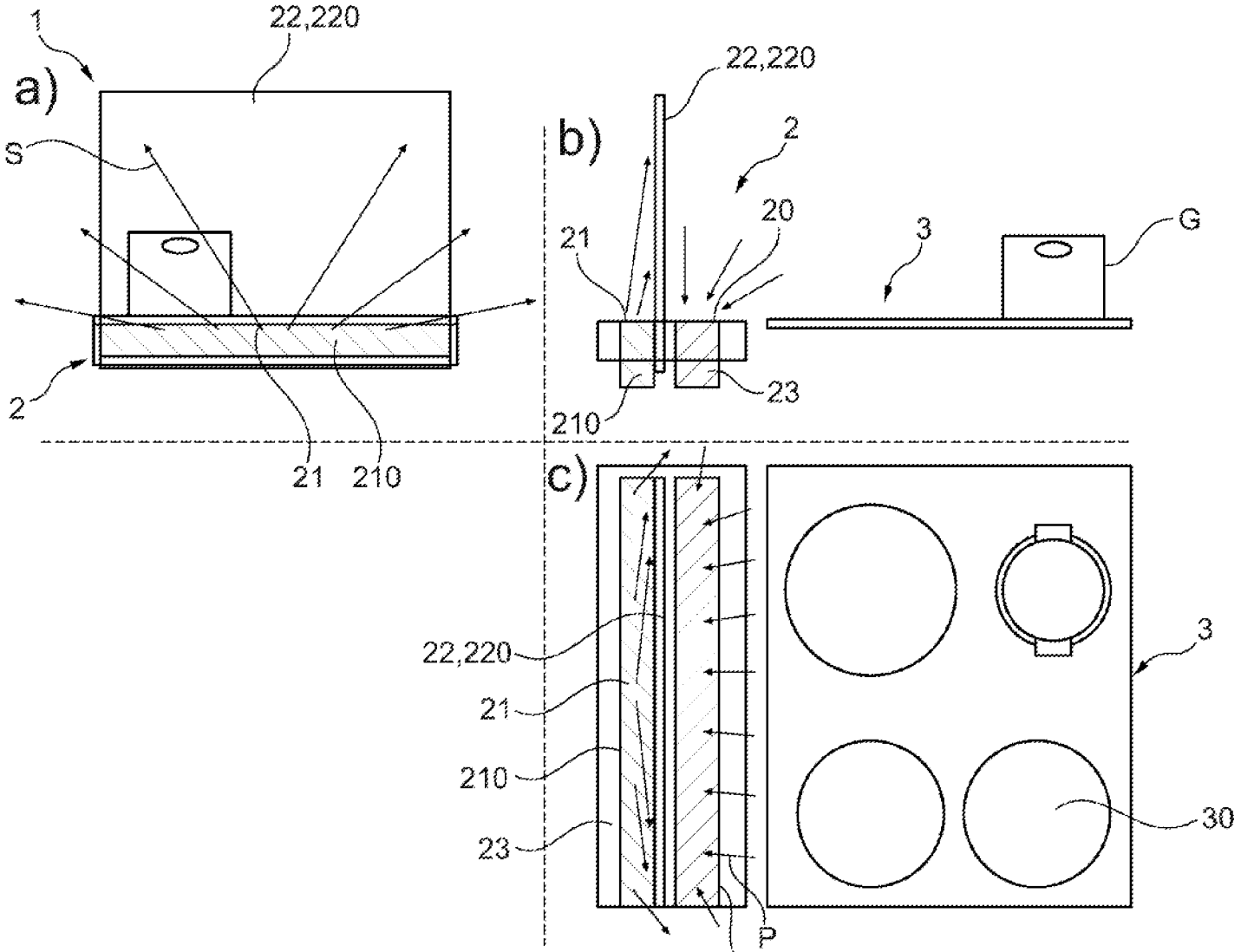
FIG. 1: A schematic rear view (1*a*), side view (1*b*), and plan view (1*c*) of a first embodiment of the inventive kitchen appliance.

FIG. 1 shows a first embodiment of the inventive kitchen appliance 1. The kitchen appliance 1 comprises a cooktop 3 and an extractor hood 2. The extractor hood 2 comprises a suction opening 20 and multiple expulsion openings 21. The expulsion openings 21 are realized in the upper side of an expulsion duct 210. A separating element 22 in the form of a deflector plate 220 is arranged between the expulsion openings 21 and the suction opening 20. Furthermore the extractor apparatus 2 has a fan (not shown) via which air is sucked into the suction opening 20. Additionally the extractor apparatus 2 can have a supplementary fan (not shown) via which air is routed to the at least one expulsion opening 21.

Furthermore the extractor apparatus 2 has a casing 23, only a cover of which is visible in FIG. 1. The cooktop 3 is arranged in front of the suction opening 20. A cooking vessel G in the form of a pot is shown schematically on the cooktop 3.

As can be seen in FIG. 1, the secondary fluid stream S is output in a fanlike manner in the first embodiment of the kitchen appliance 1. In this regard, as shown, the secondary air stream S can be expelled by the expulsion openings 21 in an oriented manner in the direction of the deflector plate 220. The way the secondary volumetric flow is generated for the secondary air stream S, and the presence or the geometry of the deflector plate 220 is irrelevant for the inventive effect in this regard.

Secondary air is expelled from the expulsion duct 210 from the expulsion openings 21. The scope of the invention includes that the expulsion duct 210 only has one expulsion opening 21, which extends over the entire length of the upper side of the expulsion duct 210. Expulsion takes place close to the deflector plate 220 as shown in FIG. 1. In this regard the secondary air can be output initially through the expulsion opening 21 in the direction of the deflector plate. Due to the proximity to the deflector plate 220 the fanlike secondary volumetric flow S establishes itself at the deflector plate 220. This effect is also referred to as a Coanda Effect. At the outer edges of the deflector plate 220 the secondary fluid undergoes a slight deflection in direction on to the cooktop and the secondary fluid stream S therefore flows off. Beyond the deflector plate 220 a boundary layer flow is created between the secondary fluid stream S. The boundary layer flow is present in this regard even without the presence of a solid boundary. The primary fluid is carried along by air friction and steered in a targeted manner in the desired direction on to the suction opening. The mass movement of the primary fluid in the direction of the flow-off edge results in a splitting of the primary fluid in the direction of the suction and away from the suction (following the secondary fluid). A continuous flow is realized. As a result the primary fluid is steered more strongly from the front and upper area of the cooktop in the direction of the suction.

Additionally an air curtain is created as a result of the secondary fluid stream S, which substantially impedes an air flow from the area in front of the deflector plate 220 to the area behind the deflector plate 220.

The effects on the vapor capture rate resulting from deflection of the primary fluid stream P due to the effect of the secondary fluid stream being carried along is described later in more detail with reference to FIGS. 4 to 8.

Figure 2:
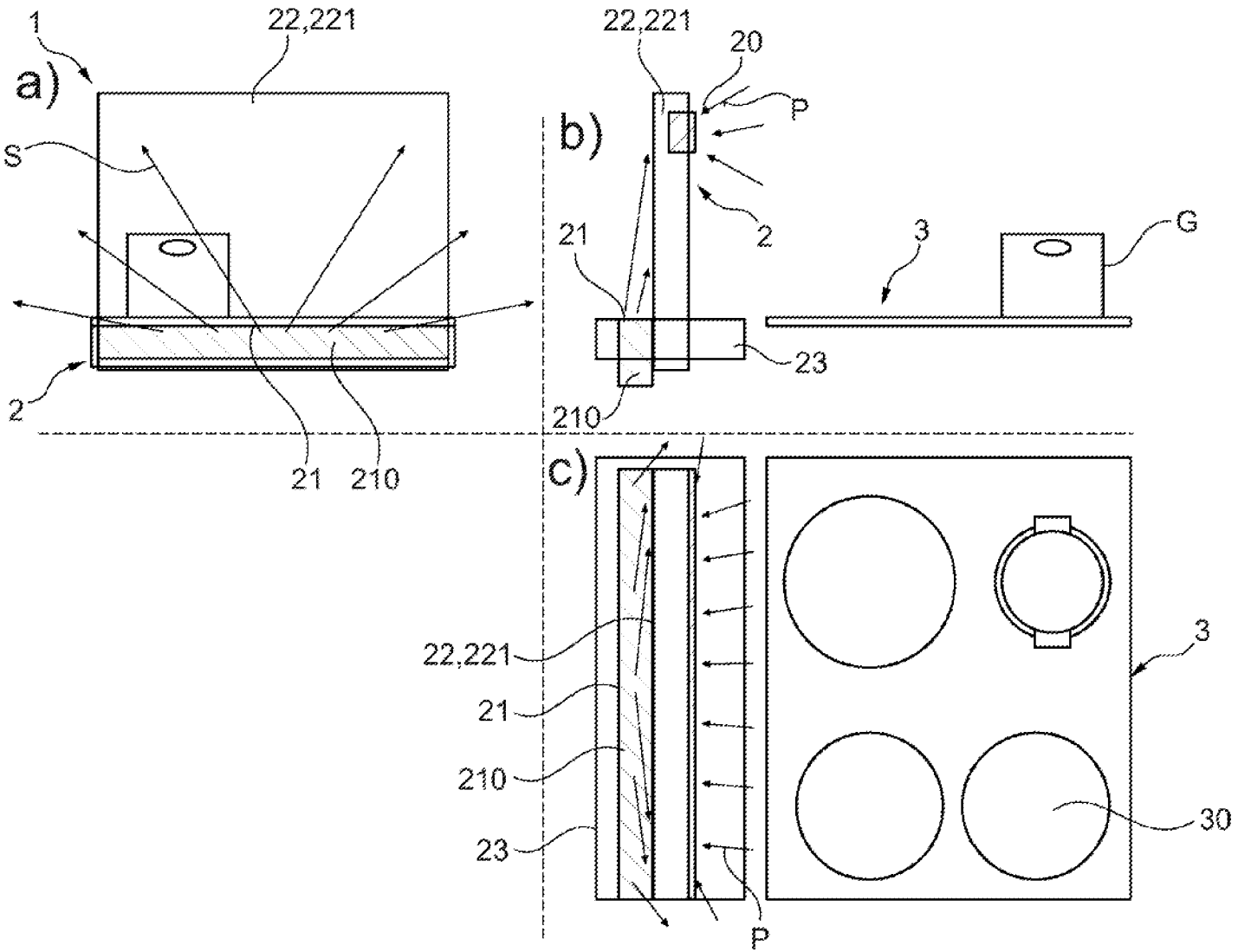
FIG. 2: A schematic rear view (2*a*), side view (2*b*), and plan view (2*c*) of a second embodiment of the inventive kitchen appliance.

FIG. 2 shows a second embodiment of the inventive kitchen appliance. The second embodiment differs from the first embodiment only in that in the second embodiment a suction unit 221 is provided as a separating element 22 in place of a deflector plate 220. The suction unit 221 comprises a hollow body closed in the upward direction, which can also be referred to as a duct. The suction opening 20 of the extractor apparatus 2 is realized in the upper area of the side of the suction unit 221. Air can be sucked via the hollow suction unit 221 to the fan located under the plane of the cooktop 3 (not shown). In this embodiment also, the secondary fluid stream S, which is expelled through the expulsion openings 21, results in a fanlike effect being realized which extends at least beyond the lateral edges of the suction unit 221. In the second embodiment according to FIG. 2 also, therefore, an entrainment effect of the primary air stream P by the secondary air stream S is generated, and the primary air stream P is reliably steered to the suction opening in the suction body 221.

Figure 3:
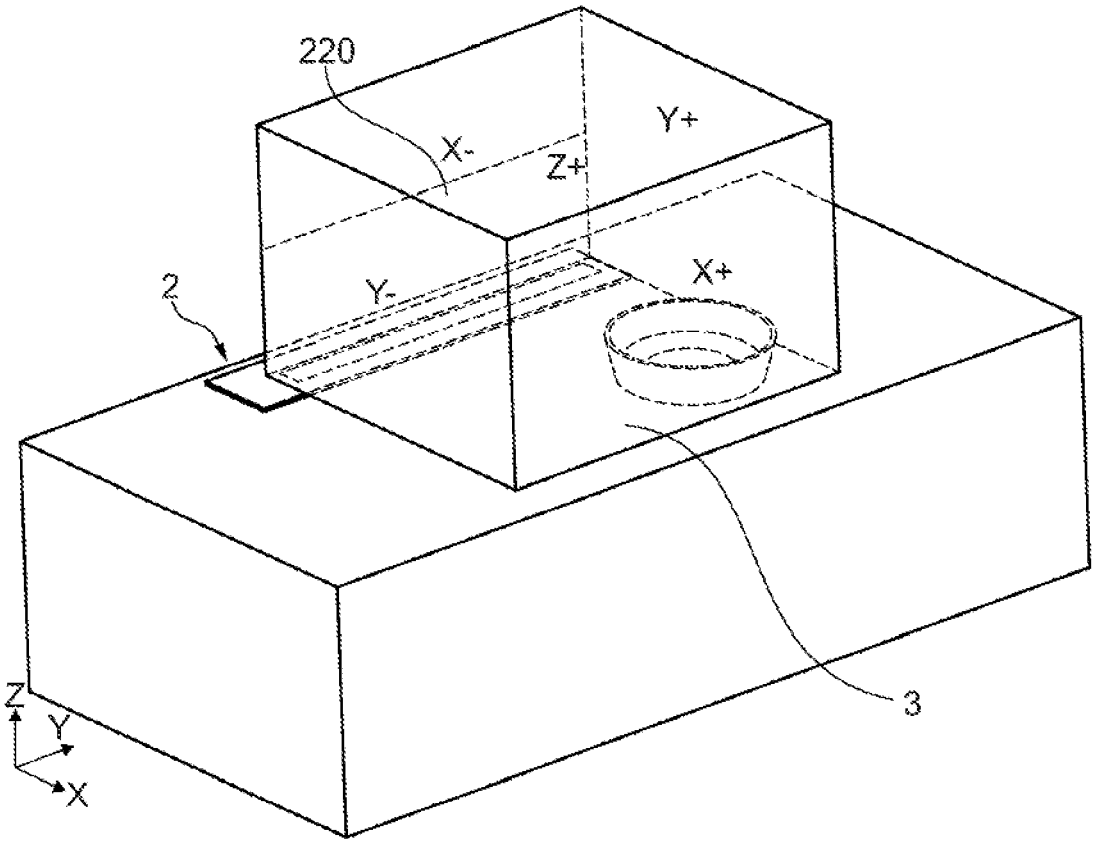
FIG. 3: A schematic perspective view of an embodiment of an inventive kitchen appliance with a system of coordinates.
Figure 3A:
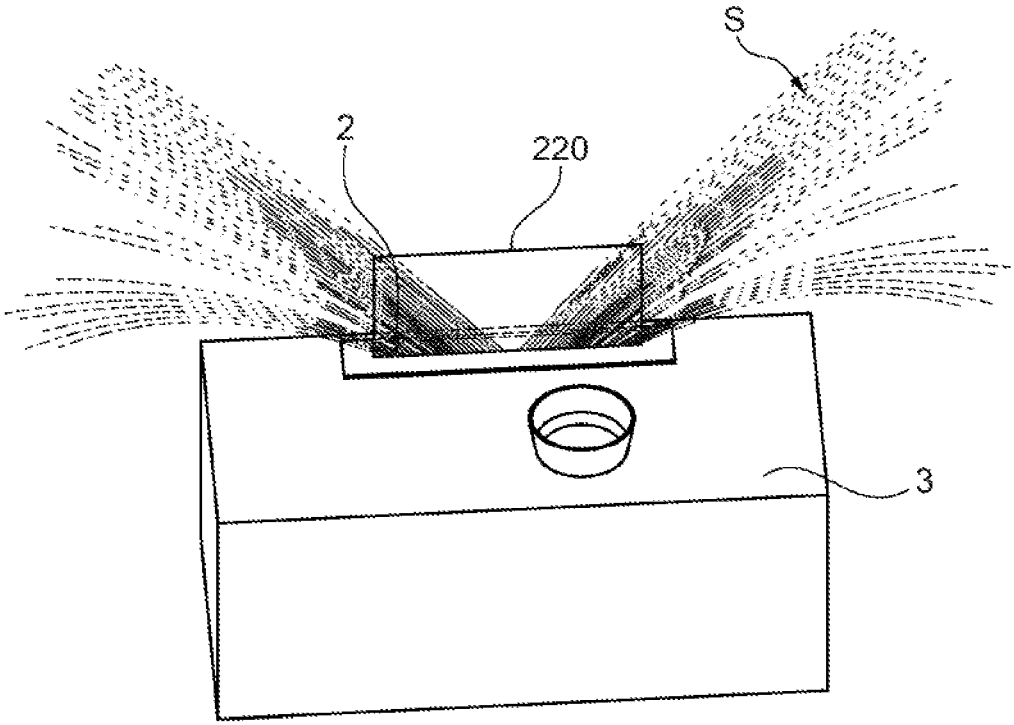
FIG. 3*a*: A schematic perspective view showing flow speeds.
Figure 4:
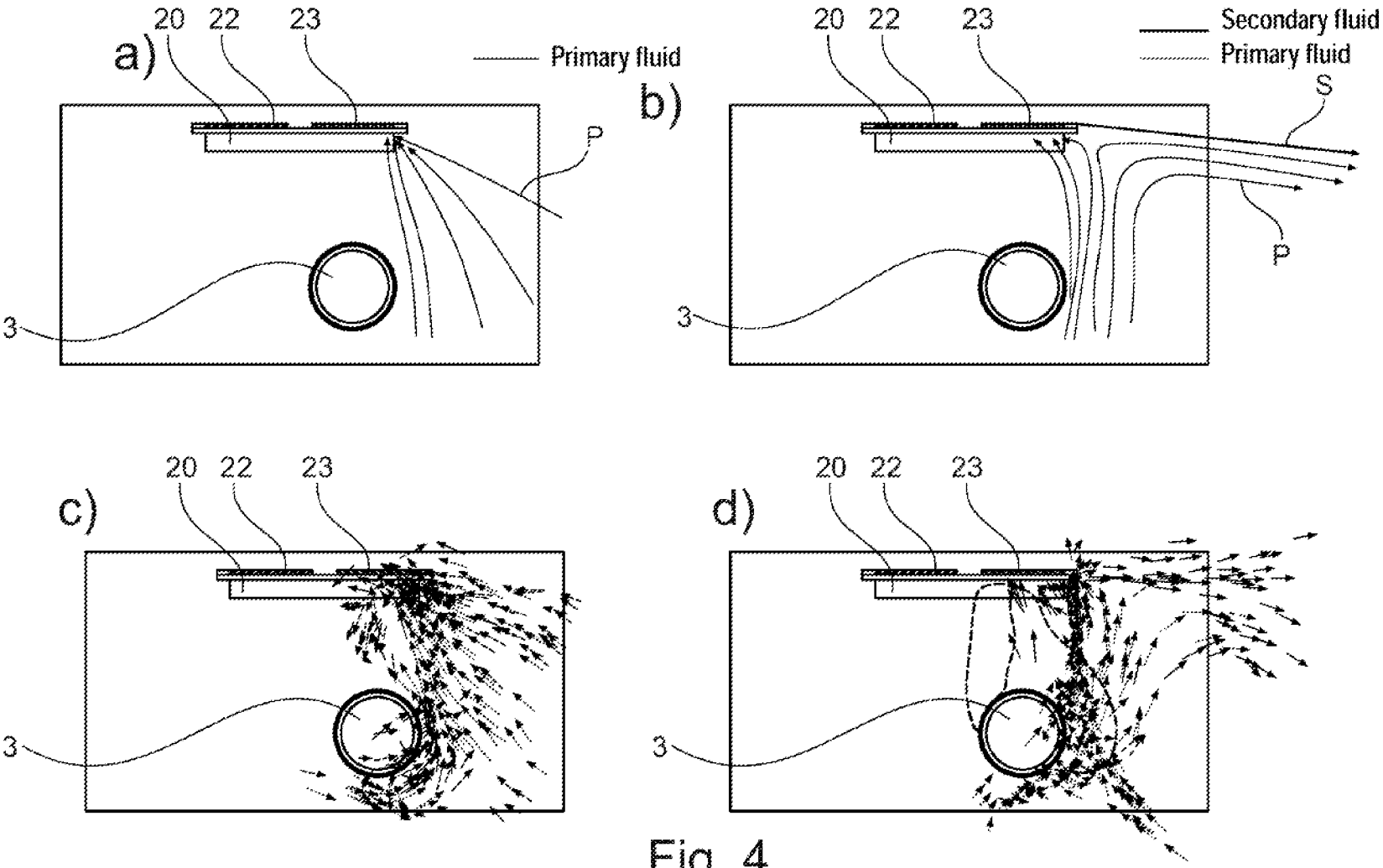
FIGS. 4*a* and 4*b*: Representations of flow behavior through the lateral planes Y+ and Y− with and without a secondary air stream in the form of flow lines.
FIGS. 4*c* and 4*d*: Representations of flow behavior through the lateral planes Y+ and Y− with and without a secondary air stream in the form of speed vectors along flow lines.
Figure 5:
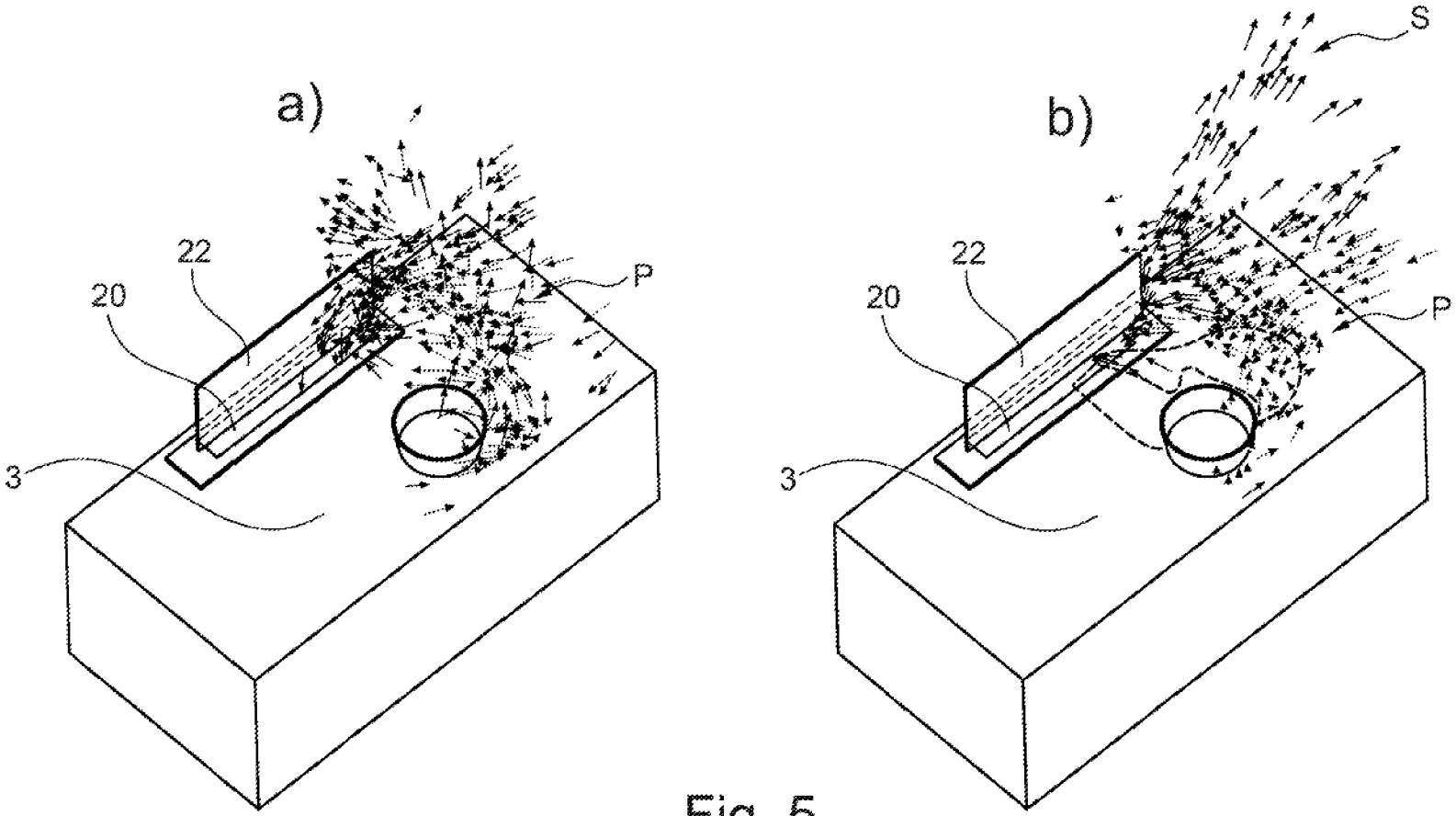
FIGS. 5*a* and 5*b*: Representations of flow behavior through the lateral planes Y+ and Y− with and without a secondary air stream in the form of speed vectors along flow lines in a perspective view.
Figure 6:
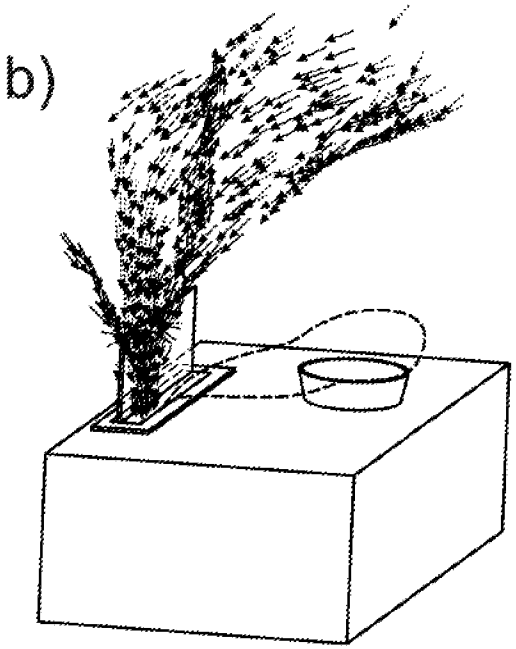
FIGS. 6*a* and 6*b*: Representations of flow behavior through the rear plane X− with and without a secondary air stream in the form of speed vectors along flow lines in a perspective view.
Figure 6:
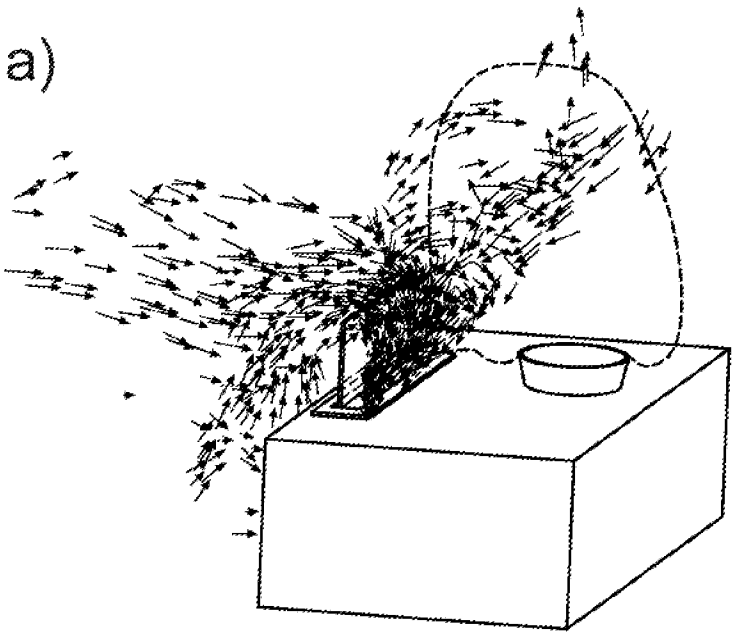
Figure 7:
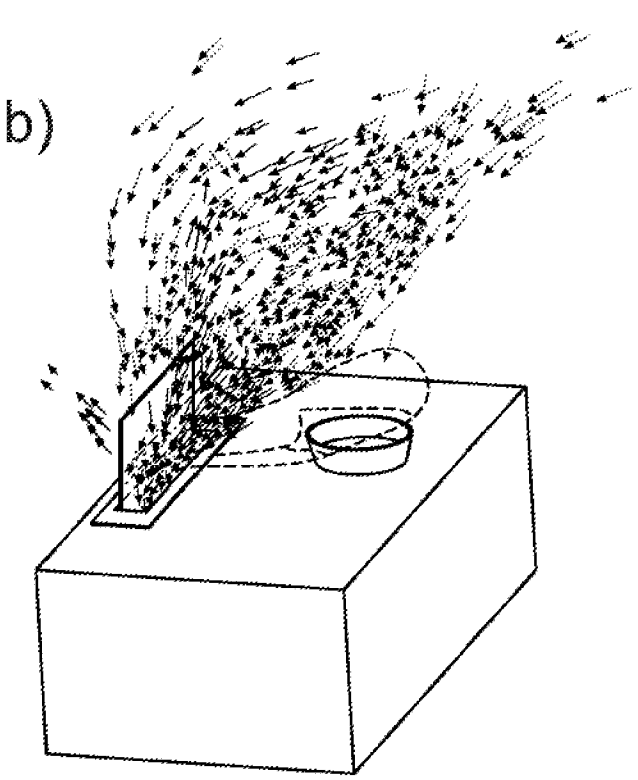
FIGS. 7*a* and 7*b*: Representations of flow behavior through the upper plane Z+ with and without a secondary air stream in the form of speed vectors along flow lines in a perspective view.
Figure 7:
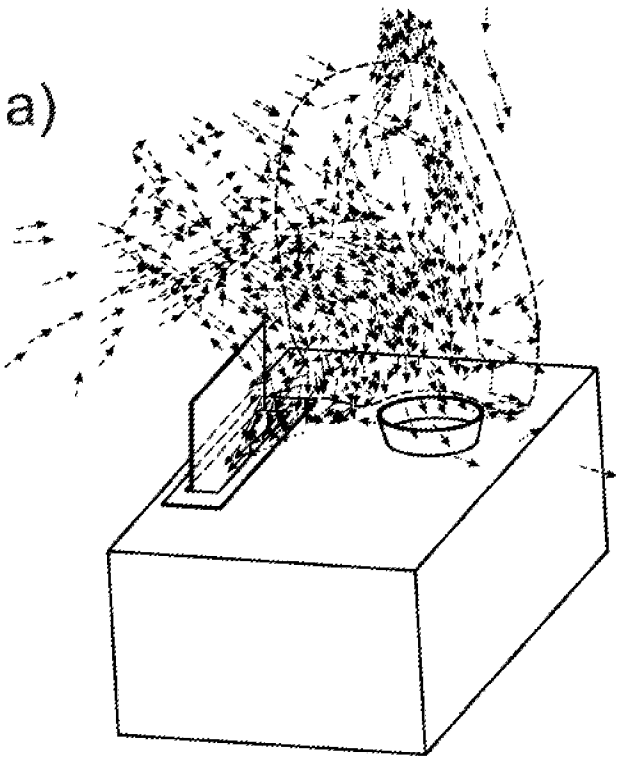
Figure 8:
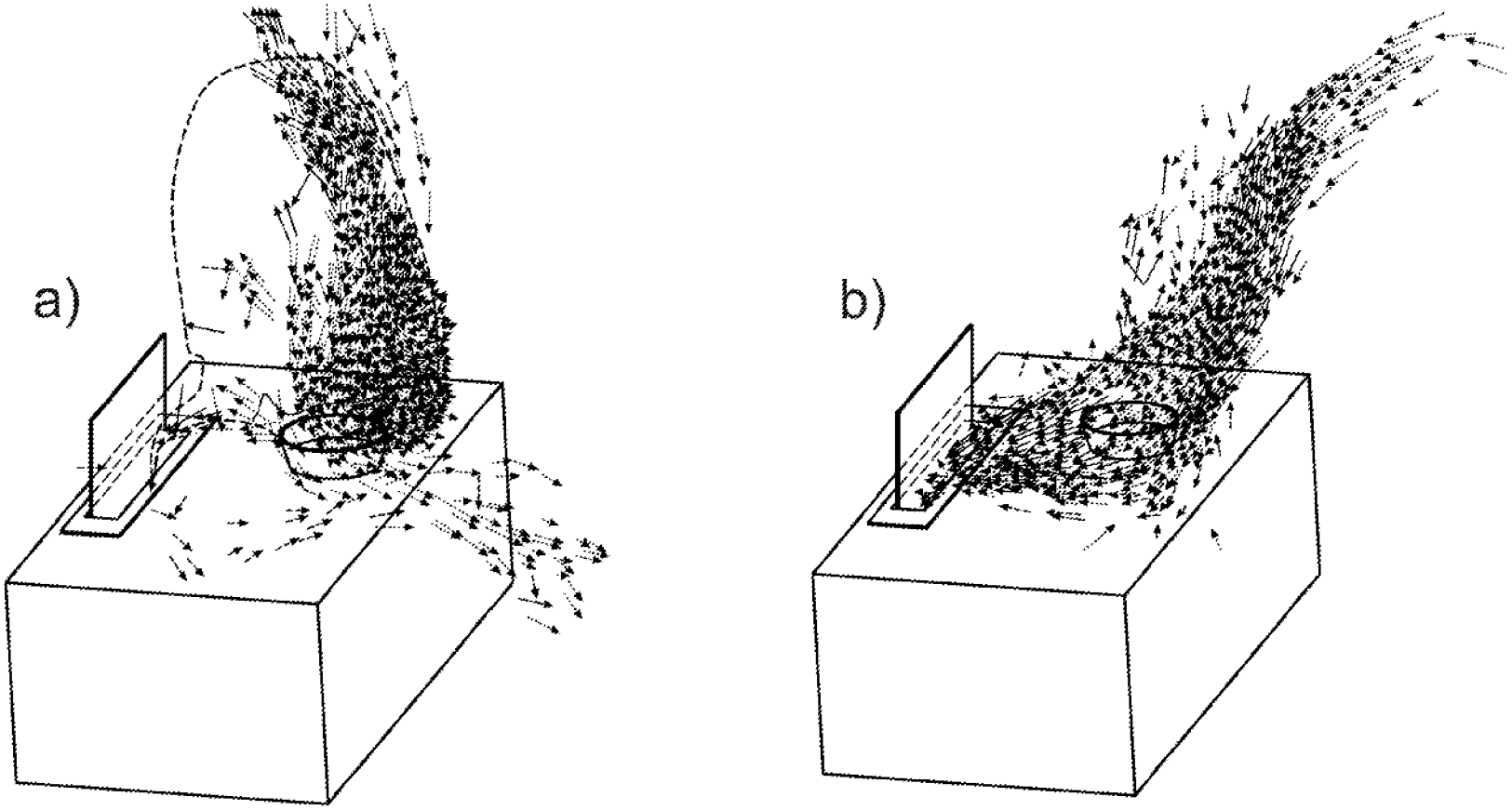
FIGS. 8*a* and 8*b*: Representations of flow behavior through the front plane X+ with and without a secondary air stream in the form of speed vectors along flow lines in a perspective view.

FIG. 3 shows the geometry of an embodiment of the kitchen appliance with reference planes. FIG. 3*a* shows the outgoing shape of the mass flow of the secondary fluid. As this diagram shows, the secondary air stream S forms a fanlike effect which extends along the rear side of the deflector plate 220 to the sides of the deflector plate 220 and projects beyond. The mass flow in the vertical direction is small. The scope of the invention also includes, however, that the secondary fluid stream S is also oriented upward and extends beyond the upper side of the deflector plate. The speed of the secondary fluid stream is higher in the vicinity of the expulsion opening and decreases with increasing distance from the expulsion opening. In particular the speed decreases from the point of reaching the edges of the deflector plate 220.

FIGS. 4 to 8 show the flow behavior through different reference planes of FIG. 3 in different diagrams. In this regard the flow behavior is shown with and without a secondary air stream in each case.

An excessively high volumetric flow, moving from the sides of the suction opening (Y+ and Y− planes) to the suction has a negative effect on the vapor capture rate. A volumetric flow of this type can arise for example due to air around the cooktop being sucked in. On the other hand the lateral primary volumetric flow only has a small influence on the vapor capture rate and uses a large part of the overall suction performance required from the fan FIGS. 4*a* and 4*b* show diagrams of the flow behavior through the lateral planes Y+ and Y− with and without a secondary air stream in the form of flow lines. As can be seen in FIGS. 4*a* and 4*b* the secondary air stream carries away parts of the primary air stream in its front area as soon as the secondary air stream passes the edge of the deflector plate. Parts of the primary fluid must follow the flow for continuity reasons. This results in the lateral outer area being separated from the inner area by an air curtain by means of the primary fluid. The outer rear area, that is to say the lateral area behind the deflector plate, is also separated from the lateral front area by the secondary air stream. The primary fluid is deflected downward in the direction of the suction opening 20 and only part of the mass of the primary fluid is carried away by the secondary fluid.

FIGS. 4*c* and 4*d* show the flow behavior through the lateral planes Y+ and Y− with and without a secondary air stream in the form of speed vectors along flow lines, and FIGS. 5*a* and 5*b* show diagrams of flow behavior through the lateral planes Y+ and Y− with and without a secondary air stream in the form of speed vectors along flow lines in a perspective view. As can be seen from these figures, a more targeted suction of the primary fluid is achieved.

FIGS. 6*a* and 6*b* show diagrams of the flow behavior through the rear plane X− with and without a secondary air stream in the form of speed vectors along flow lines in a perspective view. As can be seen from FIG. 6*a*, a large part of the primary volumetric flow that is sucked in comes from the area behind the cooktop and in particular behind the deflector plate. This volumetric flow is not desirable since in the event of the suction power being too weak it cannot carry downward the vapor arising on the cooktop, and takes up part of the overall suction power. FIG. 6*a* shows the flow behavior through the rear plane X− on the other hand. In this regard it can be seen that the lost stream from the area behind the cooktop and in particular behind the deflector plate is limited. The lost stream is limited in particular due to the secondary fluid carrying away parts of the primary fluid for continuity reasons. This occurs as early as the flow-off point at the edge of the deflector plate. As a result a tendency to flow in the direction of the suction opening and the deflector plate is imposed on the primary fluid even in the distant upper area. Additionally the secondary fluid acts as an air curtain that hinders the sucking in of primary fluid from behind the deflector plate.

FIGS. 7*a* and 7*b* show diagrams of the flow behavior through the upper plane Z+ with and without a secondary air stream in the form of speed vectors along flow lines in a perspective view. In particular the flow behavior in the vicinity of the cooking vessel G is shown as a result. The primary volumetric flow is deflected downward in the direction of the suction opening and deflector plate by the effect of the secondary air stream.

As can be seen from FIGS. 8*a* and 8*b*, which show diagrams of the flow behavior through the front plane X+ with and without a secondary air stream in the form of speed vectors along flow lines in a perspective view, the effect of the secondary air stream is also effective in the front area of the cooktop. The primary volumetric flow, as changed by the secondary volumetric flow, acts against the naturally rising thermal properties of the vapor and carries same in the direction of the deflector plate to the suction opening.

Figure 13A:
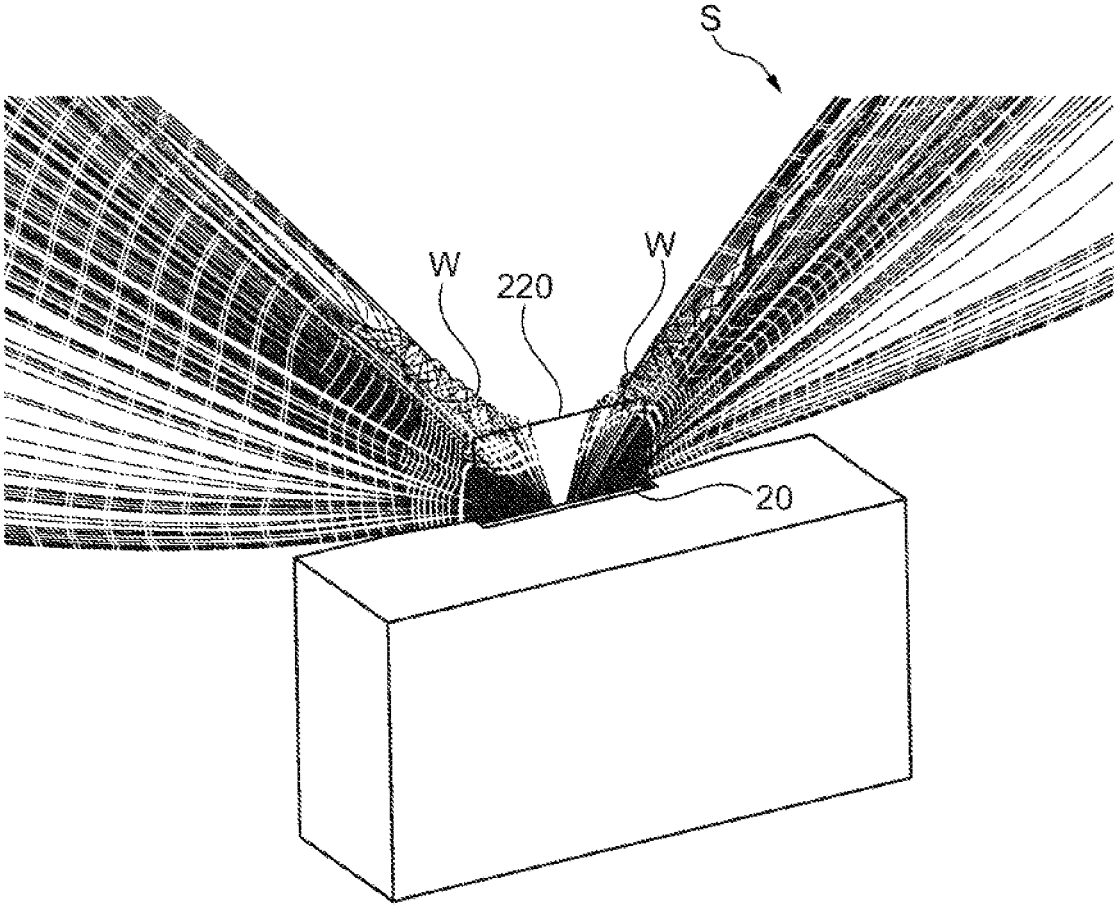
FIG. 13*a*: A schematic perspective view showing flow speeds.

FIG. 13*a* shows the outgoing shape of the mass flow of the secondary fluid in an embodiment of the extractor apparatus. As can be seen from this diagram, the secondary air stream S forms a fanlike effect which extends along the rear side of the deflector plate 220 to the sides of the deflector plate 220 and projects beyond. The mass flow in the vertical direction is smaller. In particular the fanlike effect of the secondary air flow splits up.

Figure 13B:
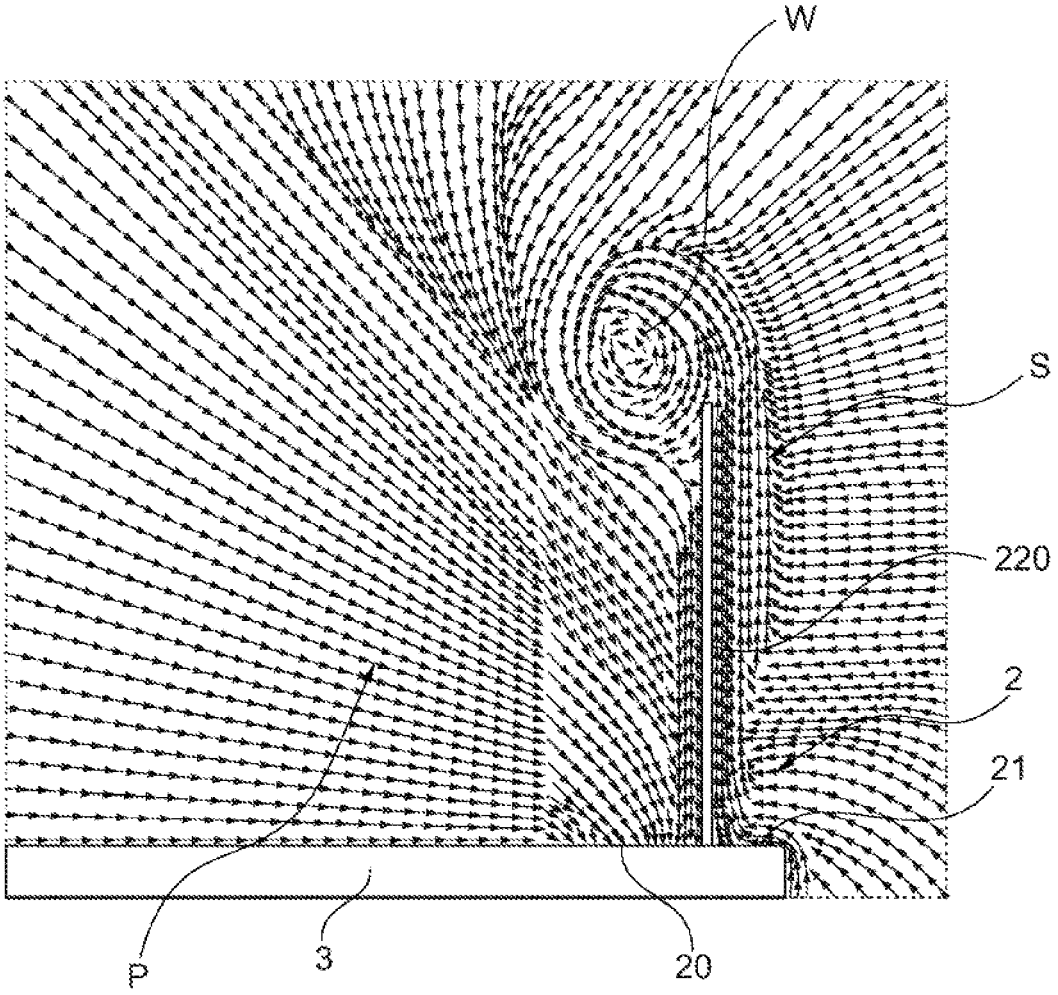
FIG. 13*b*: A schematic side view of the embodiment shown in FIG. 13 with a tangential projection of the speed vectors.

As a result of the secondary air stream S flowing off at the upper edge of the deflector plate 220 and the suction of the primary air stream (not shown in FIG. 13*a*) in front of the deflector plate 220, two eddies W are formed. The eddies W are produced by a rolling up of the secondary air stream as soon as it passes the upper edge of the deflector plate 220. In the ideal case the eddies W are stationary. The eddies W result in an additional component being created which deflects the rising vapor, that is to say the primary air flow, prematurely downward in the direction of the suction opening. This is shown schematically in FIG. 13*b*, which shows a tangential projection of the speed vector on to a plane normal to the Y axis at a distance of 100 mm from the vertical outer edge of the deflector plate 220. In this diagram it is possible to identify the eddy formation at the upper edge of the deflector plate 200, in particular the rolling up of the secondary air stream at the upper margin of the deflector plate 220 and the effect on the primary air stream in the lower area of the deflector plate 220. This additionally prevents the vapor being carried away by the secondary air stream in the outer area of the deflector plate 220.

Figure 9:
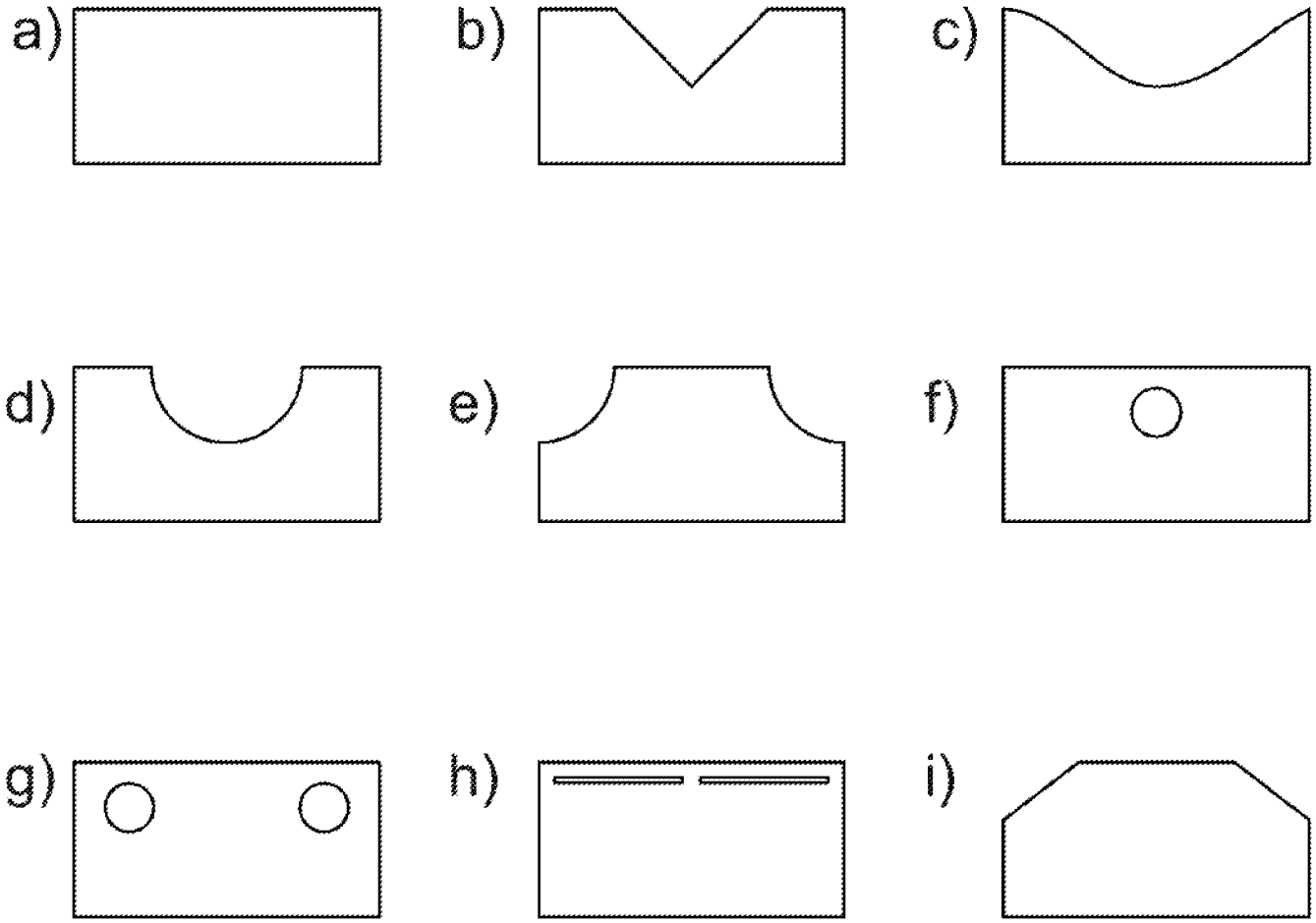
FIG. 9: Schematic representations of different embodiments of a separating element in a front view.

The precise shape of the deflector plate is not significant. However, a minimum height can be advantageous to separate the primary volumetric flow and the secondary volumetric flow from each other so that no primary flow containing vapor is carried away in the lower area. The height and width of the deflector plate are not critical for the functional principle. However different optimal dimensions can be selected for different use cases, for example the height of the deflector plate depending on the pot height, or the width depending on the cooktop width. As explained above the shape of the separating element and in particular of the deflector plate exerts no influence on the effect of the secondary air stream. Different types and shapes of deflector plate can be used therefore. FIG. 9 shows different shapes of deflector plate in schematic form. As can be seen from FIG. 9 depressions can be provided on the upper side of the deflector plate (FIGS. 9*b*, 9*c* and 9*d*). It is also possible to provide one or more openings in the surface of the deflector plate (FIGS. 9*f*, 9*g* and 9*h*). Lastly it is also possible to bevel the upper edges of the deflector plate (FIG. 9*i*) or provide same with depressions (FIG. 9*e*). It has been found that in spite of the different shapes, the effect of the primary air stream being deflected or steered to the suction opening by the secondary air stream is maintained.

Figure 10:
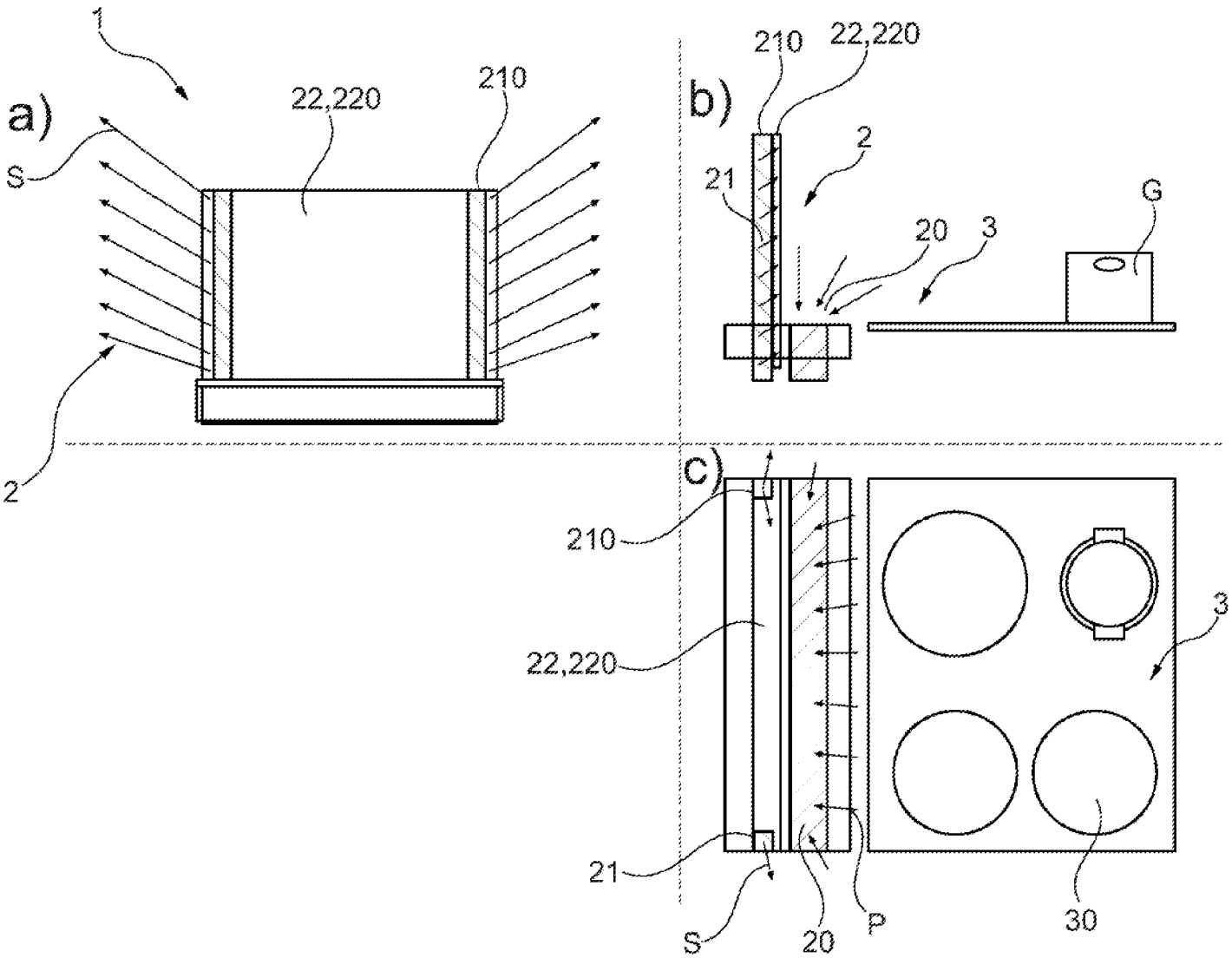
FIG. 10: A schematic rear view (10*a*), side view (10*b*), and plan view (10*c*) of a third embodiment of the inventive kitchen appliance.

FIG. 10 shows a third embodiment of the inventive kitchen appliance 1. This third embodiment differs from the first embodiment shown in FIG. 1 only by the configuration of the expulsion duct 210. In the third embodiment, two expulsion ducts 210 running vertically are provided in place of one expulsion duct 210 lying horizontally. The expulsion ducts 210 are located on the side of the deflector plate 220 facing away from the suction opening 20. The expulsion ducts 210 are provided on the outer lateral margins of the deflector plate 220. The expulsion openings 21 are located on the respective expulsion duct 210 on the side facing the outside. In the third embodiment also, therefore, a secondary air stream S is output to the sides to the outside. In the embodiment shown in FIG. 10 the expulsion openings 21 are designed such that the secondary air stream S is output upward in a fanlike manner. The scope of the invention also includes however that the expulsion openings 21 are designed such that the secondary air stream is output downward in a fanlike manner. At least the lower expulsion openings 21 of the expulsion ducts 210 can be oriented downward.

Figure 11:
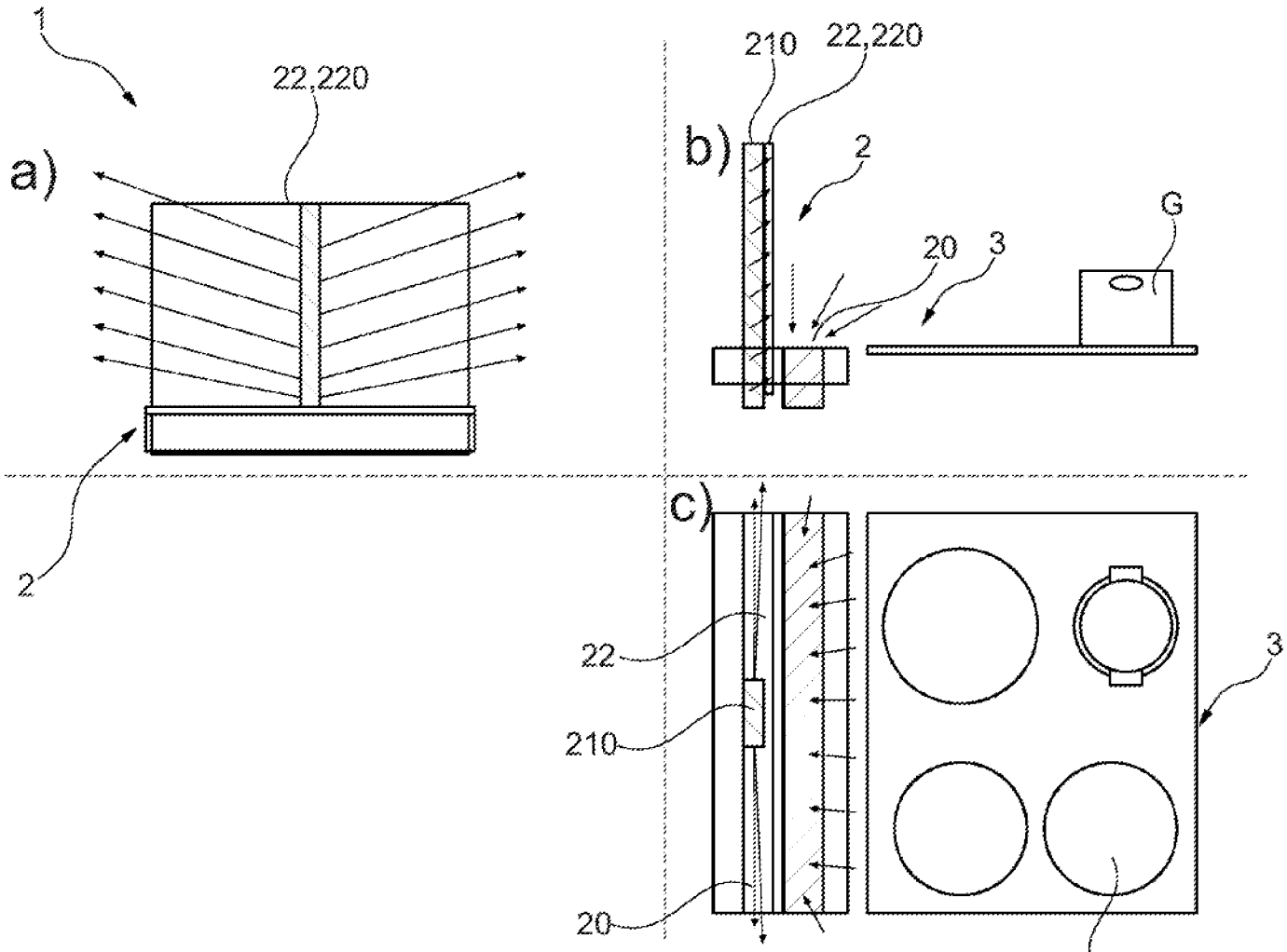
FIG. 11: A schematic rear view (11*a*), side view (11*b*), and plan view (11*c*) of a fourth embodiment of the inventive kitchen appliance.

FIG. 11 shows a fourth embodiment of the inventive kitchen appliance 1. This fourth embodiment differs from the third embodiment shown in FIG. 10 only by the configuration of the expulsion duct 210. In the fourth embodiment, only one expulsion duct 210 running vertically is provided in place of the two expulsion ducts 210 running vertically. The expulsion duct 210 is located on the side of the deflector plate 220 facing away from the suction opening 20. The expulsion duct 210 is arranged in the center of the width of the deflector plate 220 and therefore also in the middle of the width of the suction opening 20. The expulsion openings 21 are located on the respectively opposite outward-facing sides of the expulsion duct 210. In the fourth embodiment also, therefore, a secondary air stream S is output to the sides to the outside. As in the first embodiment the expulsion openings 21 can also be arranged in this regard such that the secondary air stream S is expelled at an angle with regard to the deflector plate 220. In this regard the secondary air stream clings to the deflector plate due to the Coanda Effect and only flows off from same at the outer edges of the deflector plate 220. In the embodiment shown in FIG. 11 the expulsion openings 21 are designed such that the secondary air stream S is output upward in a fanlike manner. The scope of the invention also includes however that the expulsion openings 21 are designed such that the secondary air stream is output downward in a fanlike manner. At least the lower expulsion openings 21 of the expulsion ducts 210 can be oriented downward.

Figure 12:
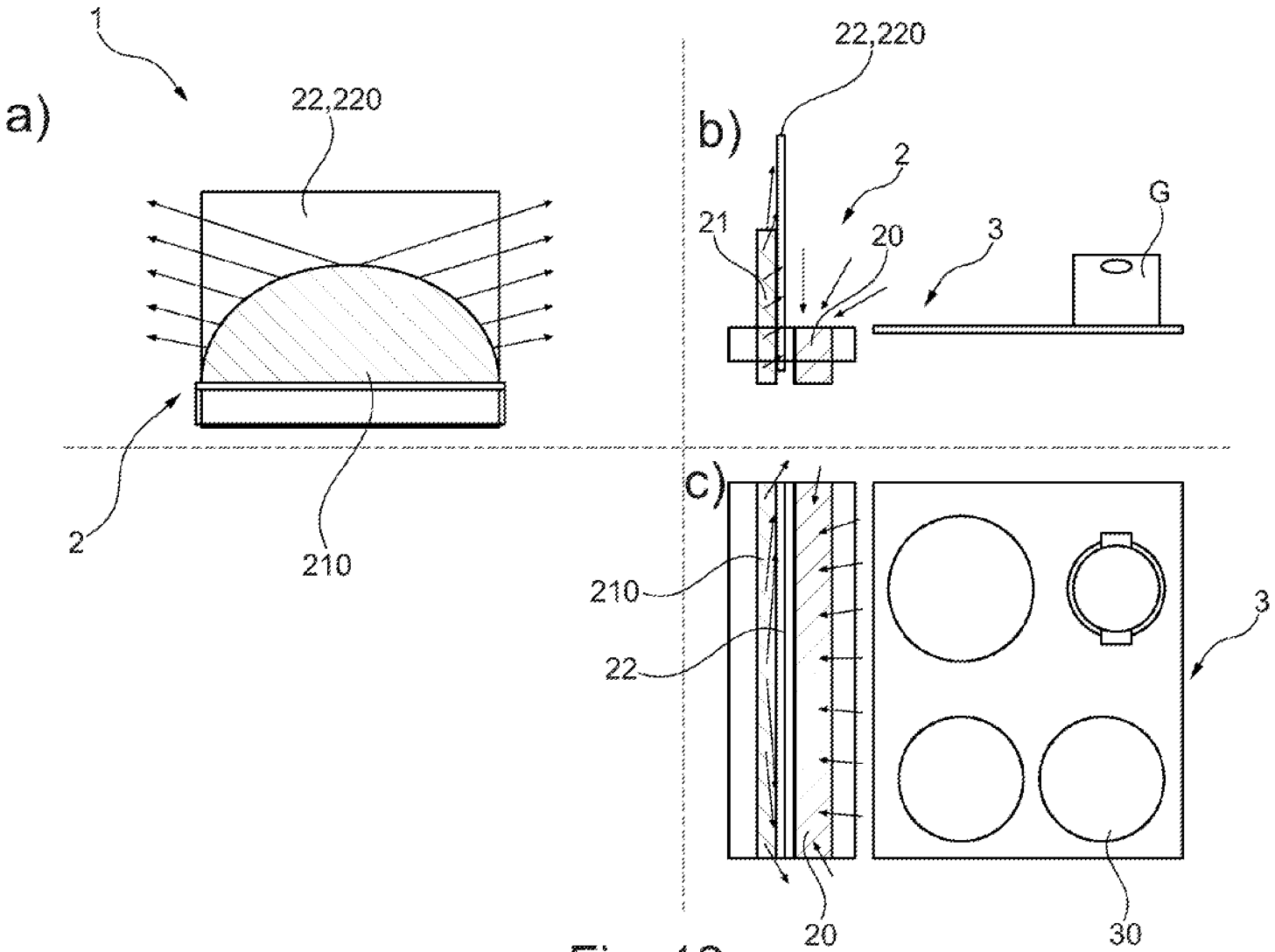
FIG. 12: A schematic rear view (12*a*), side view (12*b*), and plan view (12*c*) of a fifth embodiment of the inventive kitchen appliance.

FIG. 12 shows a fifth embodiment of the inventive kitchen appliance 1. This fifth embodiment differs from the first embodiment shown in FIG. 1 only by the configuration of the expulsion duct 210. In the fifth embodiment, the expulsion ducts 210 have a semicircular-shaped surface that extends vertically upward. The expulsion openings 21 are located in the upper side of the expulsion duct 210 and are designed such that same output a secondary air stream S to the sides to the outside. As in the first embodiment the expulsion openings 21 can also be designed in this regard such that the secondary air stream S is expelled at an angle with regard to the deflector plate 220. In this regard the secondary air stream clings to the deflector plate due to the Coanda Effect and only flows off from same at the outer edges of the deflector plate 220. In the embodiment shown in FIG. 12 the expulsion openings 21 are designed such that the secondary air stream S is output upward in a fanlike manner.

The present invention is not limited to the embodiments shown by way of example. In particular the shape and arrangement of the expulsion openings, of the deflector plate and of the suction opening can diverge from the embodiments shown. The embodiments shown in the figures can be combined with each other. For example the nature of the suction opening and of the separating element in the second embodiment can be combined with any of the expulsion variants of the third to fifth embodiments.

In all cases however the oriented secondary air stream will steer and in particular deflect the vapor such that the same arrives at the suction openings in a targeted manner. The exhaust-air stream, that is to say the primary air stream, is sucked in at the front side of the deflector plate, and the oriented secondary air stream is expelled behind the deflector plate. As a result of the targeted air routing the volumetric flow in the space above the cooktop can be regulated from above, in front and behind. The suction can take place on a full-spread basis in front of a deflector plate. A similar mode of functioning exists if the position of the secondary fluid nozzle or of the suction is changed and the target volumetric flow of the secondary fluid is maintained.

According to the invention it is consequently possible to reduce the required suction power and therefore the noise generated.

The present invention has a number of advantages. By means of the present invention, vapor extraction behavior can be improved and additionally noise can be minimized and energy efficiency increased due to a lower discharge volume requirement for countertop ventilation systems. In particular a very good extraction, that is to say vapor capture rate, can be achieved on cooktops lying farther away from the suction area of the suction opening and also in the case of tall pots. Current cooktop ventilation systems can only suck vapor in over a limited distance. The distance of approx. 380-450 mm that exists at the front cooking zone of a four-zone cooktop cannot be overcome with the usual delivery volumes, that is to say the vapor created on the front cooking zone cannot be sucked away. This problem does not arise with the present invention due to the targeted secondary air routing. Additionally, problem-free suction is ensured with regard to cross-currents. Furthermore a lower fan motor power is required and as a result noise generation is minimized even in the case of higher suction powers. Lastly no additional cut-outs and/or construction spaces are needed around the cooktop with the present invention since the expulsion openings, a deflector plate where relevant, and a supplementary fan where relevant, can be installed in the extractor apparatus.

The invention claimed is:

1. An extractor apparatus, comprising:

a suction opening disposed in a horizontal plane;

a fan arranged under the suction opening for sucking primary air downward via the suction opening;

an expulsion opening which is adjacent to the suction opening and via which a secondary air stream is expelled; and an external separating element disposed between the suction opening and the expulsion opening, wherein the external separating element extends vertically upward from the horizontal plane beyond the suction opening and the expulsion opening.

2. The extractor apparatus of claim 1, wherein the expulsion opening lies in the horizontal plane.

3. The extractor apparatus of claim 1, wherein the expulsion opening lies in a vertical plane.

4. The extractor apparatus of claim 1, wherein the expulsion opening is tilted with regard to a vertical plane and the horizontal plane.

5. The extractor apparatus of claim 1, wherein the expulsion opening is oriented upward.

6. The extractor apparatus of claim 1, wherein the expulsion opening lies above the horizontal plane of the suction opening and is tilted downward.

7. The extractor apparatus of claim 1, further comprising an expulsion duct formed with the expulsion opening and extending upward from the horizontal plane in which the suction opening is located.

8. The extractor apparatus of claim 7, wherein the expulsion duct is arranged in a center or at lateral ends of a width of the suction opening.

9. The extractor apparatus of claim 1, wherein the separating element is a deflector plate.

10. The extractor apparatus of claim 9, wherein the deflector plate has a thickness in a range of 2 mm to 20 mm.

11. The extractor apparatus of claim 1, wherein the separating element is a suction unit, with the suction opening provided on a side of the suction unit which side faces away from the expulsion opening.

12. The extractor apparatus of claim 1, further comprising a supplementary fan connected to the expulsion opening.

13. A kitchen appliance, comprising:

a cooktop disposed in a horizontal plane; and an extractor apparatus comprising:

a suction opening disposed in the horizontal plane;

a fan arranged under the suction opening for sucking primary air downward via the suction opening;

an expulsion opening disposed adjacent to the suction opening and via which a secondary air stream is expelled, wherein the suction opening is arranged in a horizontal direction between the expulsion opening and the cooktop; and an external separating element disposed between the suction opening and the expulsion opening, wherein the external separating element extends vertically upward from the horizontal plane.

14. The kitchen appliance of claim 13, wherein the extractor apparatus is arranged behind the cooktop.

15. The kitchen appliance of claim 13, wherein the separating element extends along a width of the cooktop.

16. A method of operating an extractor apparatus, said method comprising:

sucking primary air downward via a suction opening of the extractor apparatus, wherein the suction opening is disposed in a horizontal plane on a first side of an external separating element, wherein the external separating element extends vertically upward from the horizontal plane; and outputting a secondary air stream via an expulsion opening of the extractor apparatus disposed on an opposing second side of the separating element in adjacent relation to the suction opening, wherein the external separating element extends vertically upward from the horizontal plane beyond the expulsion opening.

17. The method of claim 16, wherein the secondary air stream is aligned such as to lie in a plane that is parallel to a plane in which a longitudinal projection of the suction opening lies.

18. The method of claim 16, wherein the secondary air stream is output in a fanlike shape.

19. The method of claim 16, wherein the secondary air stream flows upward at least in a perimeter area of an upper edge of the separating element to form in a central area of the upper edge of the separating element an eddy, wherein a center of the eddy lies in front of the separating element.

20. The method of claim 16, wherein the secondary air stream is output such as to be oriented, at least in one area, from behind onto the separating element arranged between the suction opening and the expulsion opening, to flow along the separating element, to detach from a lateral edge of the separating element, and to flow laterally to the outside.

21. The method of claim 16, wherein the secondary air stream is output at a speed which is greater than a speed of a flow of the primary air at the suction opening.

22. The method of claim 16, wherein the secondary air stream is output at the expulsion opening at an average outgoing speed in a range of 6 to 7 m/s at a volumetric flow of the secondary air stream of 120 to 150 $m^3/h$.

* * * * *